US005146274A

United States Patent [19]

Hattori et al.

[11] Patent Number: 5,146,274

[45] Date of Patent: Sep. 8, 1992

[54] TONER DENSITY MEASUREMENT APPARATUS HAVING OUTPUT CHARACTERISTICS VARIABLE WITH HUMIDITY

[75] Inventors: Yoshihiro Hattori; Kazuyuki Fukui; Yoshinobu Hada, all of Osaka, Japan

[73] Assignee: Minolta Camera Co., Ltd., Osaka, Japan

[21] Appl. No.: 542,574

[22] Filed: Jun. 22, 1990

[30] Foreign Application Priority Data

Jun. 23, 1989 [JP] Japan ..... 1-161099

[51] Int. Cl.[5] ..... G03G 21/00

[52] U.S. Cl. ..... 355/208; 118/689; 118/691; 355/30; 355/215; 355/246

[58] Field of Search ..... 355/215, 208, 246, 30; 118/689, 690, 691

[56] References Cited

U.S. PATENT DOCUMENTS

| | | | |
|---|---|---|---|
| 4,310,238 | 1/1982 | Mochizuki et al. | 355/246 |
| 4,468,112 | 8/1984 | Suzuki et al. | 355/246 |
| 4,607,933 | 8/1986 | Haneda et al. | 355/246 |
| 4,742,370 | 5/1988 | Murakami et al. | 355/246 |
| 4,888,618 | 12/1989 | Ishikawa | 355/208 |
| 4,916,488 | 5/1990 | Kimura | 118/689 X |
| 4,980,726 | 12/1990 | Aoki | 355/246 |
| 5,081,498 | 1/1992 | Bares | 355/246 |

FOREIGN PATENT DOCUMENTS

| | | |
|---|---|---|
| 58-221869 | 12/1983 | Japan . |
| 59-53545 | 5/1984 | Japan . |

*Primary Examiner*—A. T. Grimley
*Assistant Examiner*—J. E. Barlow, Jr.
*Attorney, Agent, or Firm*—Price, Gess & Ubell

[57] ABSTRACT

A photoelectronic image forming apparatus reproduces an image on the basis of an electrostatic latent image produced on a photo-sensitive body by using a developer containing a toner and a carrier, and comprises a plurality of toner density measuring units for respectively producing outputs each indicative of a toner density of the developer and a toner density determining unit responsive to the outputs for determining an actual toner density so as to precisely control the tone of the image.

4 Claims, 15 Drawing Sheets

TONER DENSITY MEASUREMENT APPARATUS HAVING OUTPUT CHARACTERISTICS VARIABLE WITH HUMIDITY

FIELD OF THE INVENTION

This invention relates to an electro-photographic image forming apparatus and, more particularly, to a photo-electronic image forming apparatus of the type using a two-component developer containing toner and carrier.

DESCRIPTION OF THE RELATED ART

Various controlling technologies have been employed in the electro-photographic image forming apparatus for controlling the tone of an image to be produced on, for example, a paper, one of the controlling technologies is known as "ATDC (Auto-Toner Density Control)" system and the other is referred to as "AIDC (Auto-Image Density Control) system". The ATDC system directly detects the toner density of a developer by using a magnetic sensor and controls the amount of toner to be supplied depending upon the toner density. On the other hand, the AIDC system adjusts parameters used in an image forming process to respective standard values, creating a latent image under the standard conditions, developing the electrostatic latent image with a toner-contained developer, detecting the luminous intensity of a reflection from the developed image by using an optical sensor, then controlling the toner density to be supplied depending upon the luminous intensity detected.

In another prior art example, the ATDC system is combined with the AIDC system and both of the magnetic sensor and the optical sensor are incorporated in the combined system. For example, Japanese Patent Application laid-open (Kokai) No. 58-221869 discloses a combined system; the combined system controls the toner density to be supplied in accordance with the AIDC controlling technology and the developer is prevented from an excess toner density on the basis of data provided from a magnetic sensor.

Another combined controlling technology is disclosed in Japanese Patent Application laid-open No. 59-57264. In the controlling technology disclosed therein, the toner density is basically regulated by the ATDC system and an optical sensor is further employed therein for preventing an image from decreasing the tone due to lapse of time.

Still another combined controlling technology is disclosed in Japanese Patent Application laid-open No. 62-118374 and the combined controlling system regulates a standard toner density to be used in the ATDC controlling technology to a target value on the basis of a detected value fed from an optical sensor.

Thus, the prior art controlling technologies incorporate a magnetic and/or optical sensor for regulating the toner density and, for this reason, the precision of a controlling system surely depends upon the accuracy of the detected value produced by these sensors.

Description is hereinbelow made on a humidity dependency of the sensor. As described in conjunction with the controlling technology, the precision of the controlling technology is dominated by the accuracy of the detected data and, therefore, the sensor or sensors incorporated in the system need to be constant in operation. However, not only the magnetic sensor but also the optical sensor tend to be affected by humidity of the ambience therearound. In other words, each sensor has a humidity dependency. FIG. 1 shows output voltage level of a magnetic sensor in terms of a toner density, and humidity of the ambience is used as a parameter. Plots A1 is indicative of variation in the output voltage level at humidity of 15% RH, and plots A2 and A3 stand for variations in the output voltage level at humidity of 65% RH and at humidity of 85% RH, respectively. It will be understood from FIG. 1 that the output voltage level of the magnetic sensor is increased with humidity. This phenomenon can be derived from the fact that the amount of electric charges on each developing particle is varied with humidity. FIGS. 2A and 2B illustrate the particles different in humidity. In FIGS. 2A and 2B, each circle C1, C2, C3 or C4 stands for a carrier and toner particles TN (which are respectively indicated by dots) are carried on the carrier so as to form a two-component developing particle D1, D2, D3 or D4. If the humidity is relatively low, the toner-contained developing particles D1 and D2 are sufficiently charged and, accordingly, the coulomb force between the charged developing particles D1 and D2 are so large that the charged developing particles D1 and D2 are spaced apart by a relatively large distance as shown in FIG. 2A. However, if the humidity is increased, the amount of the electric charges and, accordingly, the coulomb force between the toner-contained developing particles D3 and D4 are decreased. This allows the charged developing particles D3 and D4 to be closer than the particles D1 and D2 as shown in FIG. 2B. Such a variation in density of the developing particle results in a difference in permeability of the toner-contained developer, and the magnetic sensor varies the output voltage level depending upon the permeability.

The humidity also has an influence on the optical sensor. FIG. 3 indicates an output voltage of an optical sensor in terms of a toner density. Plots B1 stands for the output voltage level of the optical sensor at humidity of 85% RH, and plots B2 and B3 are indicative of the output voltage levels at humidity of 65% RH and at humidity of 15% RH, respectively. Comparing the plots B1, B2 and B3, it will be understood that the output voltage level of the optical sensor is decreased with humidity and, therefore, the optical sensor has a different humidity dependency from the magnetic sensor. In detail, the optical sensor is of the optical coupler 500 consisting of a photo-emitting element 500A and a photo-detecting element 500B and an optical radiation 500C is fallen onto a photo-sensing drum 501. The optical radiation 500C is reflected from the photo-sensing drum 501 and a reflection 500D is detected by the photo-detecting element 500B as shown in FIGS. 4A and 4B. Since the two-component developing particles are carried on an electrostatic latent image formed on the photo-sensing drum 501, the luminous intensity of the reflection 500D is inversely dependent on the density of the developing particles carried on the drum 501. If the humidity is relatively high, the amount of electric charges on the photo-sensitive drum 501 is decreased and a relatively large amount of the developing particles 502 are carried on the electrostatic latent image because the photo-sensitive drum 501 is kept in a constant voltage level. This allows the luminous intensity of the reflection to be decreased as shown in FIG. 4A. However, a relatively low humidity increases the amount of electric charges on the photo-sensitive drum 501 and, accordingly, decreases the amount of the developing particles 502 on the same electrostatic latent image as shown in FIG. 4B. This results in that the luminous intensity of the reflection 500D is increased. The output voltage level of the optical sensor 500 is assumed to be proportional to the luminous intensity of the reflection 500D and, for this reason, the output voltage level of the optical sensor 500 is inversely proportional to the humidity.

However, such a humidity dependency is causative of various problems in the controlling systems. If the controlling system is of the ATDC system without any correction on the basis of the humidity dependency, the output voltage level is indicative of a detected toner density higher than an actual toner density in the developing particles, and excess toner particles are supplied to a developing unit and undesirable excess charge and smoking tend to take place around the developing unit. If, on the other hand, a detected density is higher than the actual density in a relatively low humidity, the developing unit suffers from shortage of toner particles and an image to be reproduced tends to be poor in the clearness.

Similar problem is encountered in the AIDC controlling system and the problem is serious if humidity is widely different between the termination of image forming operation and the subsequent operation over a night because the toner-contained developer prepared at the termination is used in the subsequent operation.

Moreover, if the image forming apparatus is equipped with a multi-color developing system, a problem is encountered in reproducibility because the humidity dependency is different between the colored toner contained developers.

In order to cope with the problem inherent in the toner-contained developer due to the humidity dependency, several approaches have been proposed. One of the approaches is disclosed in Japanese Patent Publication (Kokoku) No. 59-53545. The Japanese Patent Publication teaches that a humidity sensor provided inside of an image forming apparatus reports the humidity to a table incorporated in a controlling system. The table maintains a relationship between humidity, a corrected toner density in a toner-contained developer and an output value of the humidity sensor and the table provides the corrected toner density in response to the output value supplied thereto.

However, the solution proposed in the Japanese Patent Publication is less effective against the problem inherent in the prior art controlling system. In detail, since the humidity sensor is expected to detect a humidity of the ambience around the toner-contained developer, the sensor should be close to the toner-contained developer or an image developing unit. However, if the sensor is provided in the vicinity of the image developing unit, the humidity sensor is much liable to be contaminated with the toner-contained developer. This results in deterioration of accuracy and the humidity sensor suffers from a short service life. For preventing such undesirable results, if the humidity sensor is spaced from the image developing unit, a time lag takes place between variation of humidity and the detection by the sensor. Thus, the humidity sensor located at a different spacing from the image developing unit is less prompt to a variation of the humidity, and, for this reason, the aforementioned problem tends to take place in a period of transition. This drawback is serious in activation of the image forming apparatus because the humidity around the developing unit is widely changed.

As described hereinbefore, a magnetic sensor tends to produce an output signal indicative of a detected toner density lower than an actual toner density in a relatively high humidity; however, the humidity dependency of an optical sensor causes the output signal thereof to indicate a detected toner density higher than the actual toner density in a relatively high humidity ambience. In a relatively low humidity ambience, the dependency is opposite to each other.

Thus, the magnetic sensor and the optical sensor are generally symmetrical in humidity dependency with each other and, therefore, the inventors of the present invention notice that one of the magnetic and optical sensors is available to cancel variation of the output signal with the other output. In this situation, it is important for both of the magnetic and optical sensors to be adjust to certain values at a predetermined point. For example, the output values of the magnetic and the optical sensors at toner density of 7 weight % in humidity of 50% RH should be matched to expected values.

However, the toner density is hardly adjustable at a manufacturing facility or prior to the delivery thereof. In detail, the calibration of the magnetic sensor is carried out through detection of the permeability of the developing particles actually fed to the apparatus and the characteristics of the developing unit and the charged properties of the photo-sensitive drum of the apparatus are taken into account for calibration of the photo sensor. However, the developing particles are provided to the apparatus after installation in user's office because a transport of the apparatus is liable to spill the developing particles. Even though a calibration is temporally carried out in the manufacturing facility, the transport may cause the temporal calibration to be invalid due to undesirable vibration by way of example. For this reason, the final calibration is carried out after the installation, and various conditions such as humidity are imposed in the initial calibration. As to the toner density, an initial developer or a starter has been usually checked.

An image forming apparatus is optimized in parameters such as, for example, a potential level at the photo-sensitive drum incorporated therein, a biasing voltage level in the developing unit, the exposure, a rotational velocity of an image developing sleeve, the output voltage level at the image transfer charging stage and so forth depending upon an image reproducing operation to be requested, and the optimization in the parameters changes an image to be reproduced in a tone, the brightness of colors and so forth. A half-tone image is reproduced through the optimization and the quality of image is matched to the user's request. However, the optimization is carried out through an adjustment of toner density (T/C). For example, if the toner density is adjusted to an optimum value, the tone of an image to be reproduced is varied in terms of the tone of an original image as shown in FIG. 5A. However, if the toner density is too low, the image-to-image characteristics trace plots of FIG. 5B; and plots of FIG. 5C indicates modified image-to-image characteristics upon increasing the potential level at the photo-sensitive drum. As will be understood from FIG. 5C, the modified image-to-image characteristics tell us of a drawback in reproducibility in a light tone zone even though a correction is carried out with the potential level at the photo-sensitive drum. A similar drawback is encountered in the image-to-image characteristics upon correction with another parameter. For this reason, the variation of an image to be reproduced should be carried out through a regulation of toner density and the regulation of toner density requests appropriate adjustments of the magnetic and optical sensors. Moreover, it is desirable to independently optimize the image forming parameters.

SUMMARY OF THE INVENTION

It is therefore an important object of the present invention to provide a photoelectronic image forming apparatus which precisely controls the toner density in the image developing unit incorporated therein in spite of any variation of humidity.

It is also an important object of the present invention to provide a photoelectronic image forming apparatus which promptly responds to a variation of humidity with high reliability and prolonged service life.

It is still another important object of the present invention to provide a photoelectronic image forming apparatus sensors which are easily calibrated.

It is still another important object of the present invention to provide a photoelectronic image forming apparatus which is optimized in an image forming process with a high reliability.

It is still another important object of the present invention to provide a photoelectronic image forming apparatus having the toner density precisely controllable in spite of variation of humidity.

In accordance with one aspect of the present invention, there is provided a photoelectronic image forming apparatus for reproducing an image on the basis of an electrostatic latent image produced on a photo-sensitive member by using a developer containing a toner and a carrier, comprising: a) a plurality of toner density measuring means for respectively producing outputs each indicative of a toner density of the developer; and b) toner density determining means, responsive to the outputs, for determining an actual toner density of the developer.

In accordance with another aspect of the present invention, there is provided a photoelectronic image forming apparatus for reproducing an image on the basis of an electrostatic latent image produced on a photo-sensitive member by using a developer containing a toner and a carrier, comprising: a) first toner density measuring means for producing a first output indicative of a toner density of the developer; b) second toner density measuring means for producing a second output indicative of a toner density of the developer; c) toner density determining means, responsive to the first and second outputs, for determining an actual toner density of the developer; and d) toner density controlling means for supplying the toner depending upon the actual toner density of the developer.

In accordance with still another aspect of the present invention, there is provided a photoelectronic image forming apparatus for reproducing an image on the basis of an electrostatic latent image produced on a photo-sensitive member by using a developer containing a toner and a carrier, comprising: a) a plurality of toner density measuring means for producing respective outputs each indicative of a toner density of the developer; b) humidity measuring means for measuring a humidity; c) modifying means for modifying the outputs of the plurality of toner density measuring means depending upon the humidity to be measured by the humidity measuring means; and d) toner density determining means, responsive to the outputs modified by the modifying means, for determining an actual toner density of the developer.

BRIEF DESCRIPTION OF THE DRAWINGS

The feature and advantages of the present invention will be more clearly understood from the accompanying drawings in which.

DETAILED DESCRIPTION OF PREFERRED EMBODIMENT

Description is hereinbelow made on a photoelectronic image forming apparatus embodying the present invention in detail.

General Arrangement of Controlling Unit

Figure 3:
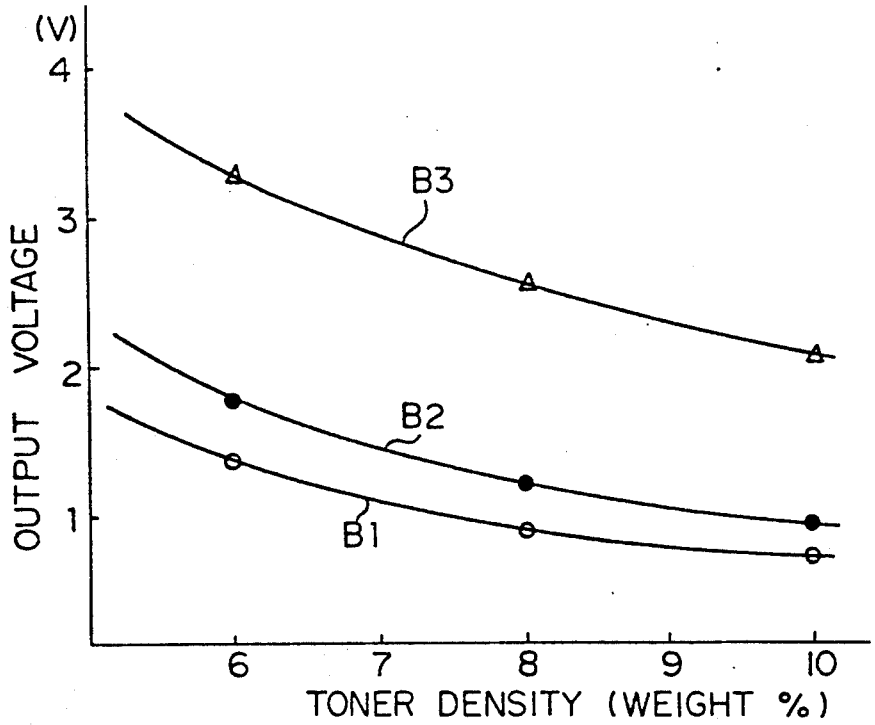
FIG. 3 PRIOR ART
FIG. 3 is a prior art graph showing the output voltage level of an optical sensor in terms of a toner density.
Figure 2B:
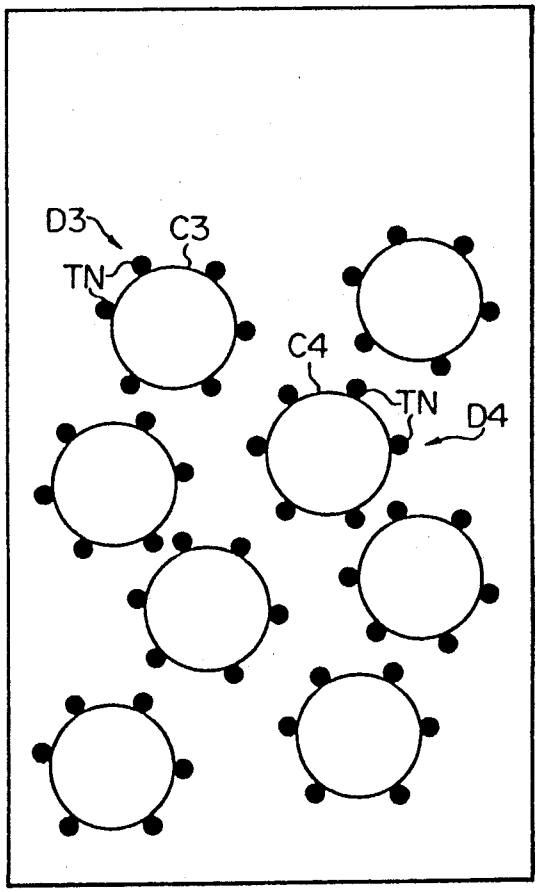
FIG.2B PRIOR ART
FIGS. 2A and 2B are prior art views showing a difference in toner density between a relatively low humidity and a relatively high humidity.
Figure 2A:
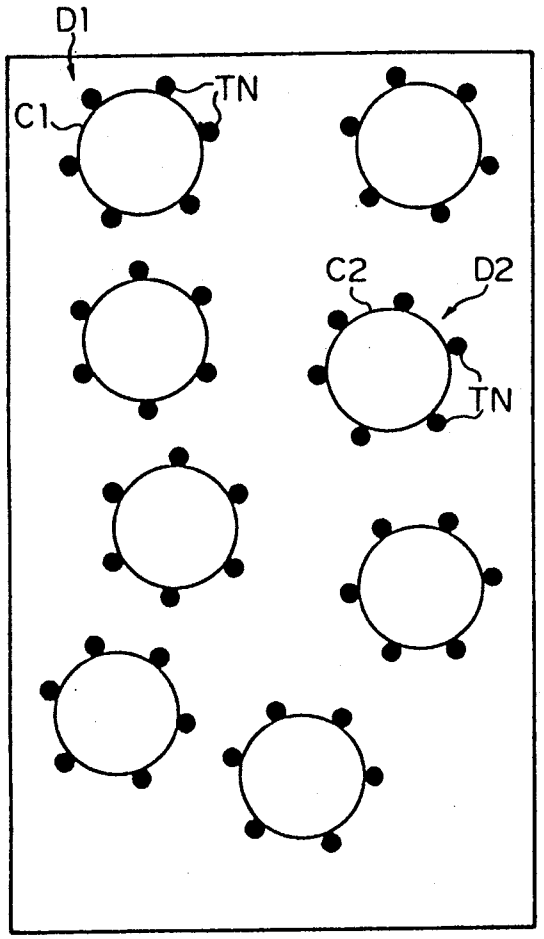
FIG.2A PRIOR ART
Figure 4A:
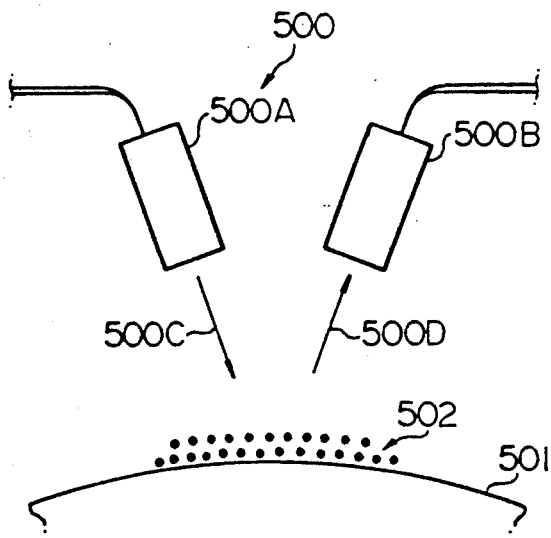
FIG.4A PRIOR ART
FIGS. 4A and 4B are prior art views showing a difference in the amount of developing particles on a photo-sensing drum between a relatively high humidity and a relatively low humidity.
Figure 4B:
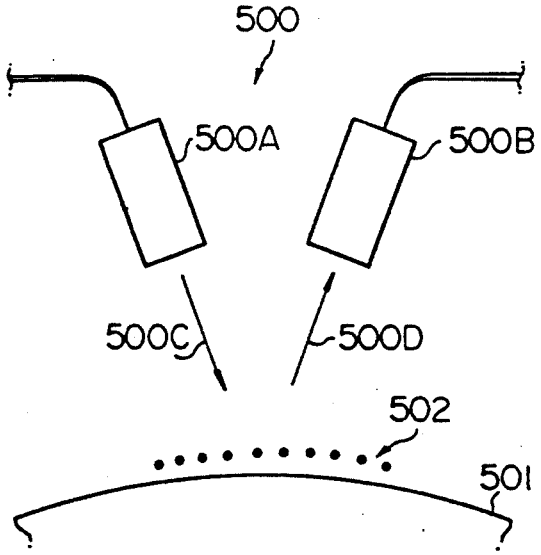
FIG.4B PRIOR ART
Figure 5A:
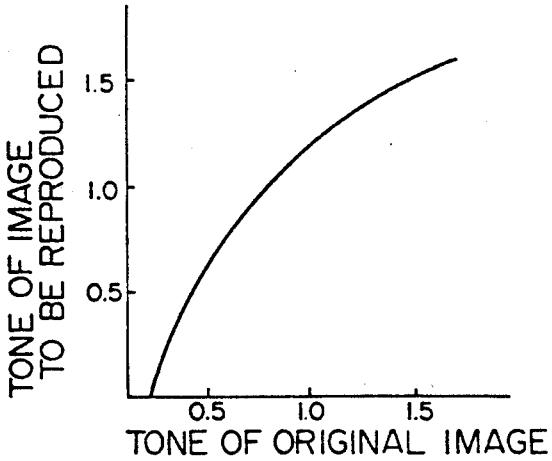
FIG.5A PRIOR ART
FIGS. 5A to 5C are prior art graphs each showing the tone of an image to be reproduced in terms of tone of an original image.
Figure 5B:
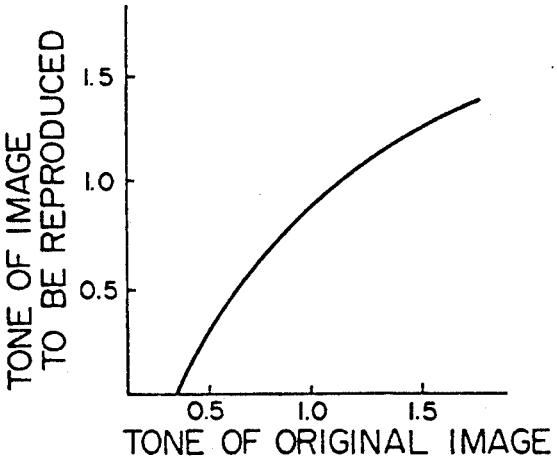
FIG.5B PRIOR ART
Figure 5C:
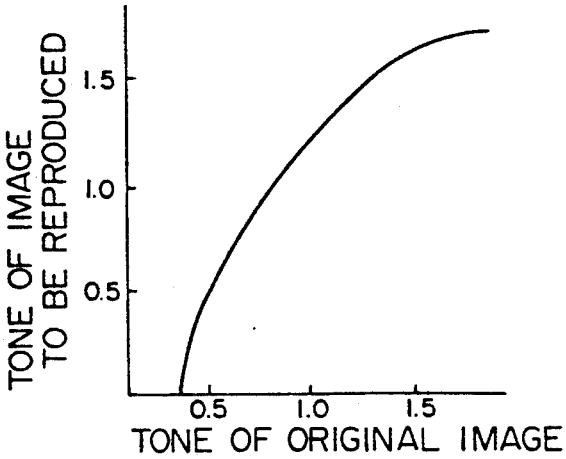
FIG.5C PRIOR ART
Figure 6:
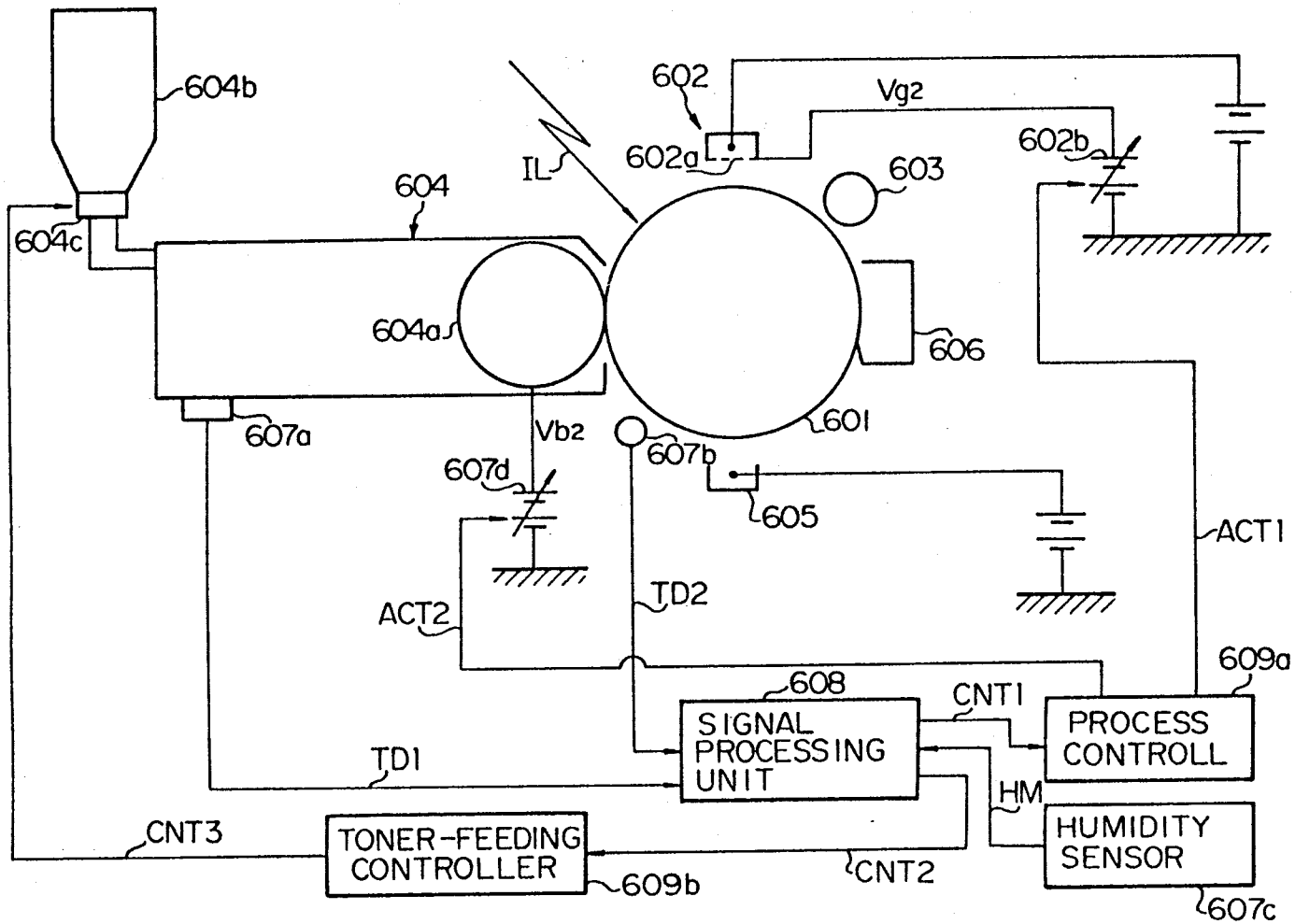
FIG. 6 is a view showing a general arrangement of a controlling unit incorporated in a photoelectronic image forming apparatus according to the present invention.

FIG. 6 is a view focused upon the arrangement around a toner density controlling section and an image forming process controlling section both incorporated in the photoelectronic image forming apparatus and FIGS. 2 and 3 show an interrelation between sensors incorporated in the image forming apparatus.

Referring first to FIG. 6, the photoelectronic image forming apparatus comprises a photo-sensitive drum 601 rotatablly supported therein and image forming elements provided around the photo-sensitive drum 601, and the image forming elements include a main charging unit 602 equipped with a mesh-grid 602*a* for sensitizing the photoconductive peripheral surface of the drum 601 by uniformly applying positive electrostatic charges and a charge eraser lamp 603 for removing the positive electrostatic charges on the photo-sensitive drum 601. The mesh-grid 602*a* is coupled to a voltage controller 602*b* and the voltage controller 602*b* determines a voltage level Vg2 at the mesh-grid 602*a* and, accordingly, positive electric charges on the photo-sensitive drum 601. An electrostatic latent image is produced by selectively remaining the positive electric charges on the drum 601 upon illumination IL with light from an original image on, for example, a document (not shown), however, no further description is incorporated hereinbelow because the production of the electrostatic latent image is well known to a person skilled in the art. The image forming elements further include a developing unit 604 equipped with a developing sleeve 604*a* for developing the electrostatic latent image with a toner-contained developer, a separation charging unit 605 for transferring the image to be developed onto a paper supplied through a paper feeder (not shown) and a drum cleaner unit 606 for removing residual toner-contained developer from the photo-sensitive drum 601. The developing unit 604 further has a toner hopper 604*b* accommodating toner particles and the toner hopper 604*b* is associated with a toner feeder 604*c* so that the toner particles are fed from the toner hopper 604*b* through revolution of a feeding rod (not shown). The toner particles thus fed therefrom are mixed into carrier particles so as to form the toner-contained developer and a toner density (or a toner to carrier ratio) of the developer is monitored and measured by a first toner density sensor 607*a*. The first toner density sensor 607*a* is of the magnetic sensor and may measure the amount of magnetic flux indicative of the magnetic permeability of the toner-contained developer. The activation of the toner feeder 604*c* and the monitoring timing will be described later. The developing sleeve 604*a* is associated with a voltage controller 607*d* and the voltage controller 607*d* controls a voltage level Vb2 at the sleeve 604*a* and, accordingly, negative electric charges of the toner particles.

Between the developing unit 604 and the separation charging unit 605 is further provided a second optical toner density sensor 607*b* which measures the intensity of a reflection of a standard developed image at a predetermined timing. The second optical toner density sensor 607*b* is of the optical sensor. The standard developed image is produced as follows. First, a standard document is irradiated with light and, accordingly, a standard latent image is produced on the photo-sensitive drum 601. The standard latent image is developed with the toner-contained developer so as to reproduce the standard developed image on the photo-sensitive drum 601. An optical radiation from the optical toner density sensor 607*b* is reflected from the standard developed image on the photo-sensitive drum 601, and the intensity of the reflection is indicative of the shade of the standard developed image. The photo-sensitive drum 601, the image forming elements and the first and second toner density sensors 607*a* and 607*b* are accommodated in a housing (not shown) and a humidity sensor 607*c* is located in a relatively clean area in the housing. Such a relatively clean area may be in the vicinity of an air intake formed in the housing and a fresh air flow prevents the humidity sensor 607*c* from contamination due to, for example, a toner-contained developer. The humidity sensor 607*c* thus provided in the clean area is less liable to be subjected to heat attack generated by the illumination IL and/or a heater provided in association with a thermo-roller for fixing the toner-contained developer transferred to a paper.

Figure 7:
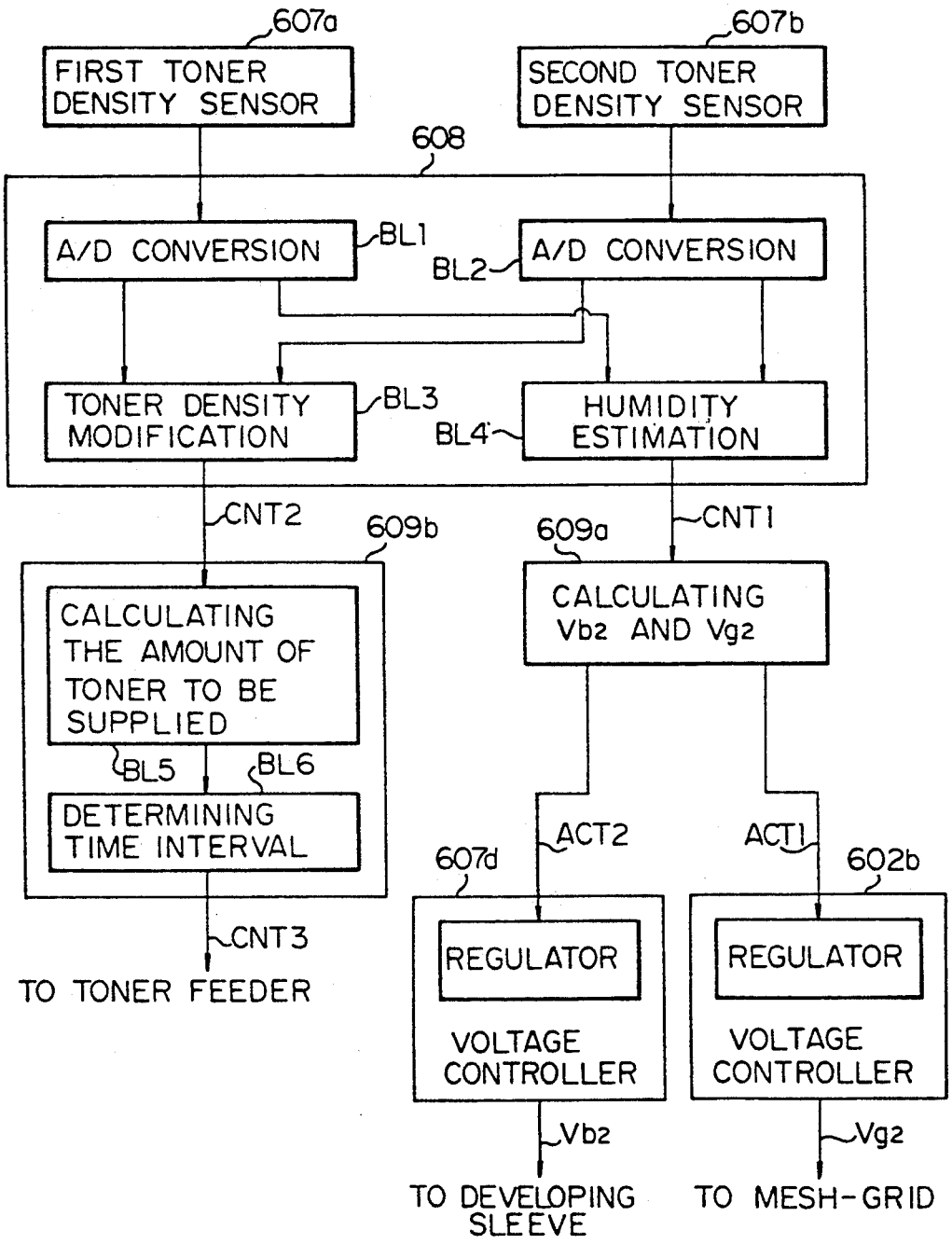
FIG. 7 is a block diagram showing an interrelation between a magnetic sensor and a optical sensor both incorporated in the image forming apparatus shown in FIG. 6.

The output signals TD1, TD2 and HM respectively fed from the toner density sensors 607*a* and 607*b* and the humidity sensor 607*c* are transferred to a signal processing unit 608. A process controller 609*a* and a toner-feeding controller 609*b* are provided in association with the signal processing unit 608. The process controller 609*a* is responsive to a first control signal CNT1 fed from the signal processing unit 608 and supervises the voltage controllers 602*b* and 607*d* and the toner-feeding controller 607. On the other hand, the toner-feeding controller 609*b* is responsive to a second controlling signal CNT2 and controls a toner feeding operation carried out by the toner feeder 604*c*. When the signal processing unit 608 enters an image forming mode of operation, the signal processing unit 608 behaves as shown in FIG. 7. However, if the operation is shifted to a calibration mode, the signal processing unit 608 achieves an operation shown in FIG. 8.

Image Forming Mode of Operation

The output signals TD1 and TD2 of the first and second toner density sensors 607*a* and 607*b* are of the analog signal and the signal processing unit 608 converts the first and second toner density signals TD1 and TD2 into a digital form as indicated by blocks BL1 and BL2. The output signals TD1 and TD2 thus converted in the digital form are supplied to a table which maintains a mutual relationship between the output signals TD1 and TD2, humidity to be estimated from the output signals TD1 and TD2 and an actual toner density corrected in consideration of the humidity and, therefore, a toner density modification and a humidity estimation are carried out in the signal processing unit 608 as indicated by blocks BL3 and BL4. The humidity thus estimated is carried on the first control signal CNT1 fed to the process controller 609*a* and the process controller 609*a* calculates the voltage levels Vb2 and Vg2. The voltage level Vg2 is nearly equal to a voltage level Vo2 at the photo-sensitive drum 601 after being positively charged. The voltage level Vg2 thus calculated is carried on a first actuation signal ACT1 which is fed to the voltage controller 602*b*, thereby allowing the voltage controller 602*b* to apply the voltage level Vg2 to the mesh-grid 602*a*. The other voltage level Vb2 is represented by a second actuation signal ACT2 and the developing sleeve 604*a* is adjusted to the voltage level Vb2.

The second control signal CNT2 is supplied to the toner feeding controller 609*b* which calculates the amount of toner particles to be supplied from the toner hopper 604b as indicated by a block BL5. The toner feeding controller 609b further calculates a time interval after which the toner feeder 604c must be actuated as indicated by a block BL6. Then, a third control signal CNT3 indicative of the time interval is supplied from the toner feeding controller 609b to a toner feeder 604c. With the third control signal CNT3, the toner feeder 604c intermittently actuated and the toner particles are supplemented from the toner hopper 604b to the developer 604 so that the toner-contained developer is regulated to a desirable density.

In this instance, the voltage level at the mesh-grid Vg2 and the voltage level at the developing sleeve 604a are selected as the image forming process parameters, however, any of the intensity of the illumination IL, the revolution speed of the developing sleeve 604a and the output voltage level at the separation charging unit 606 may be employed in another implementation. Moreover, FIG. 11b provides individual blocks to the signal processing unit 608, the process controller 609a and the toner feeder controller 609b, respectively, but these individual blocks do not indicate an actual arrangement of semiconductor chips. The voltage controllers 602b and 607d are responsive to the control signals CNT1 and CNT2 and regulate the voltage levels Vg2 and Vb2, respectively; however, another implementation may be previously provided with various voltage nodes different in voltage level and each of the control signals CNT1 and CNT2 may select one node from them.

Calibration Mode of Operation

Figure 8:
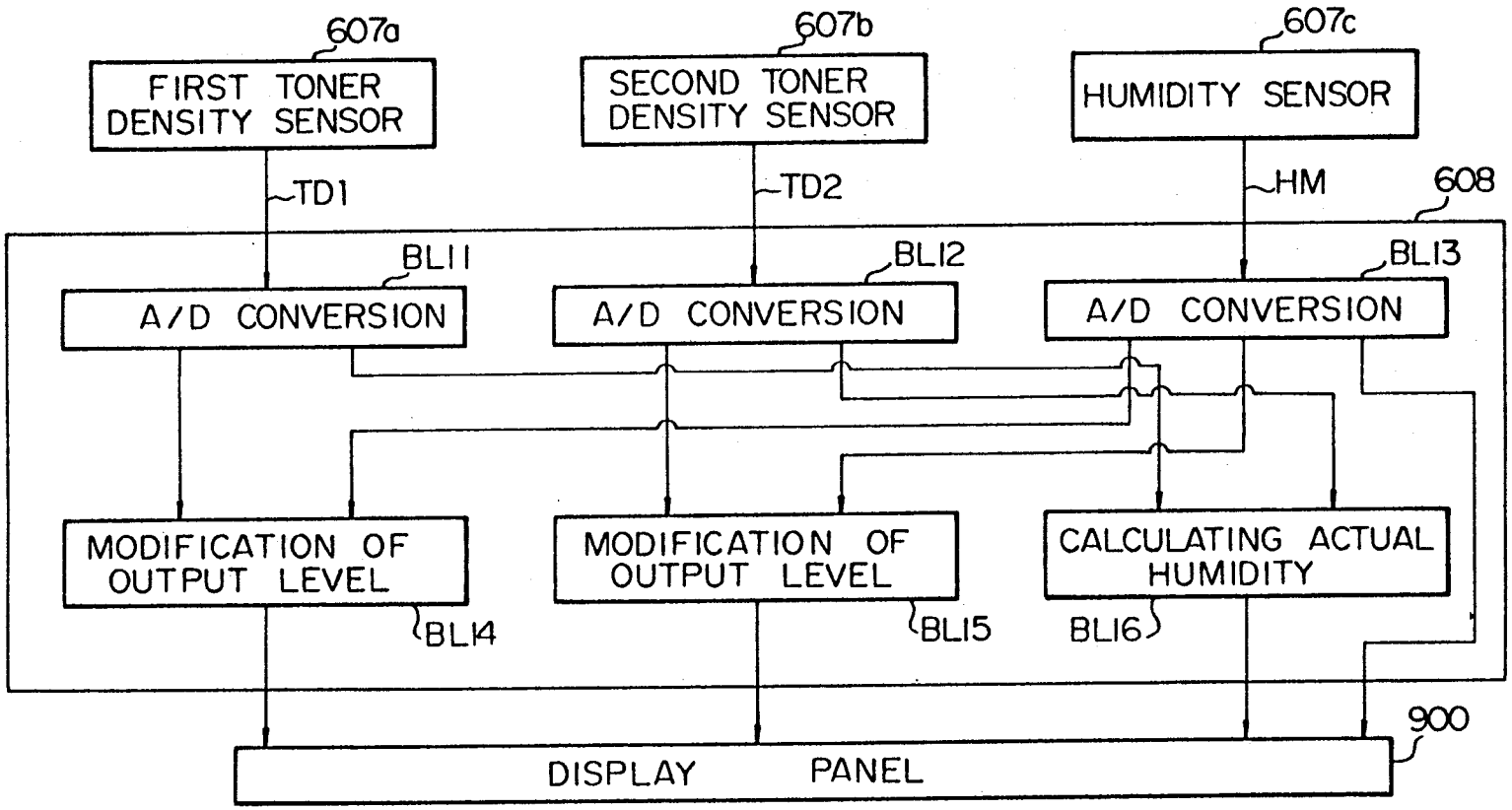
FIG. 8 is a block diagram showing an interrelation between the magnetic sensor, the optical sensor and a humidity sensor incorporated in the image forming apparatus shown in FIG. 6.
Figure 9A:
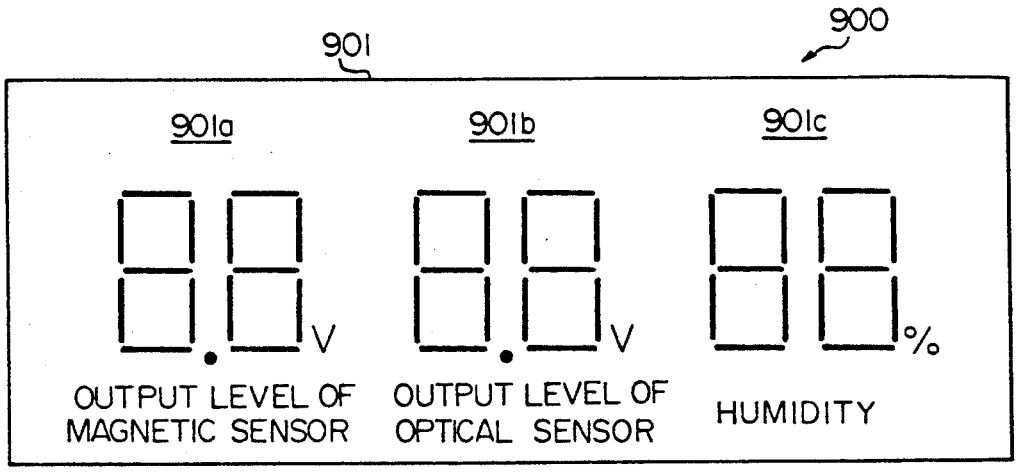
FIG. 9A and 9B are separate views each showing the arrangement of a part of a display panel incorporated in the image forming apparatus according to the present invention.

If a mode switch (not shown) is manipulated by an operator for the calibration mode of operation, the signal processing unit 608 enters the calibration mode of operation and is responsive to the output signal HM as well as the output signals TD1 and TD2 as shown in FIG. 8. Since the output signal HM is also of the analog signal, the output signals TD1, TD2 and HM are converted in the digital form as indicated by blocks BL11, BL12 and BL13. The output signals TD1, TD2 and HM thus converted in the digital form are used for modifying the output voltage levels of the first and second toner density sensors 607a and 607b (as indicated by blocks BL14 and B115) and for calculating an actual humidity (as indicated by a block BL16). These are displayed on a display panel 900 provided on the housing as shown in FIG. 9A, and the display panel 900 includes a character display 901. The character display 901 are divided into three sections 901a, 901b and 901c, and the modified output voltage levels of the first and second toner density sensors 607a and 607b are displayed in the first and second sections 901a and 901b, respectively. The third section 901c indicates the humidity. When these data are displayed on the character display 901, an operator calibrates the first and second toner density sensors 607a and 607b with reference to a table where an interrelation between the humidity, the toner density and the modified output levels of the sensors 607a and 607b is shown. An initial toner density of a developer has been known and the humidity is displayed on the third section 901c, then the operator determines target values of the respective toner density sensors 607a and 607b from the table. The operator tunes the first and second toner density sensors 607a and 607b for calibration until the modified output levels displayed on the sections 901a and 901b are matched with the target values.

Figure 9B:
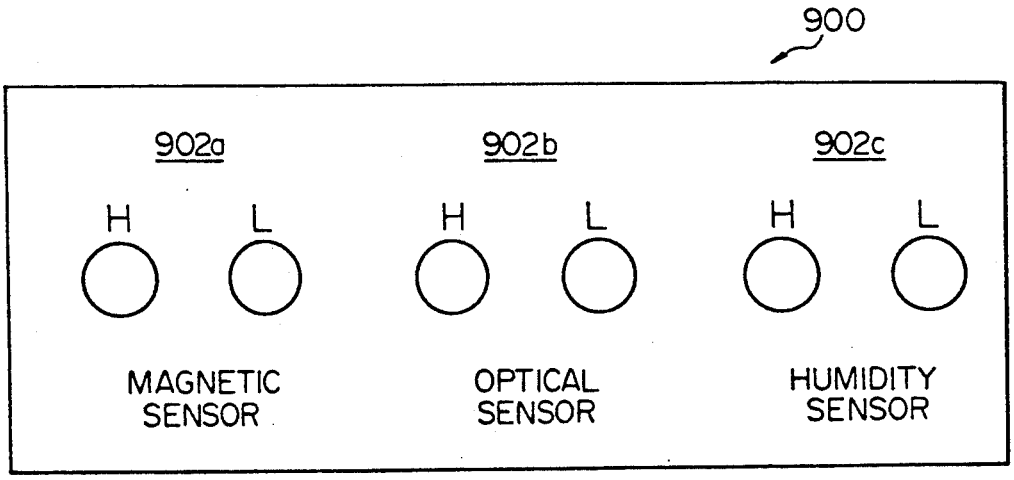

The display panel 900 may be arranged as shown in FIG. 9B, and the display panel 900 includes three sets of indicators 902a, 902b and 902c. In this instance, the table is established in a memory (not shown) incorporated in the signal processing unit 608, and the signal processing unit compares the modified output levels of the first and second toner density sensors 607a and 607b with the target value fetched from the memory. If the modified output level is higher than the target value, one of the indicators 902a (or 902b) labeled with "H" is illuminated; however, the display panel 900 illuminates the other indicator labeled with "L" with a comparison result that the modified output level is lower than the target value. The operator calibrates the first and second toner density sensors 607a and 607b until no indicator is illuminated. The third indicator pair 902c is also constituted by two indicators respectively labeled with "H" and "L" and one of the indicators 902c is illuminated depending upon a comparison result. Namely, the actual humidity calculated from the output levels of the first and second toner density sensors 607a and 607b is compared with the measured humidity indicated by the output signal HM and the display panel 900 lets the operator know whether or not the calculated humidity is higher than the measured humidity through illumination of either indicator "H" or "L". The operator then repeats the calibration for the humidity sensor 607c until both indicators are extinguished.

Thus, the controlling unit of the present invention assists the operator so that the operator easily calibrates the toner density sensors 607a and 607b as well as the humidity sensor 607c.

Arrangement of Image Forming Apparatus

Figure 10:
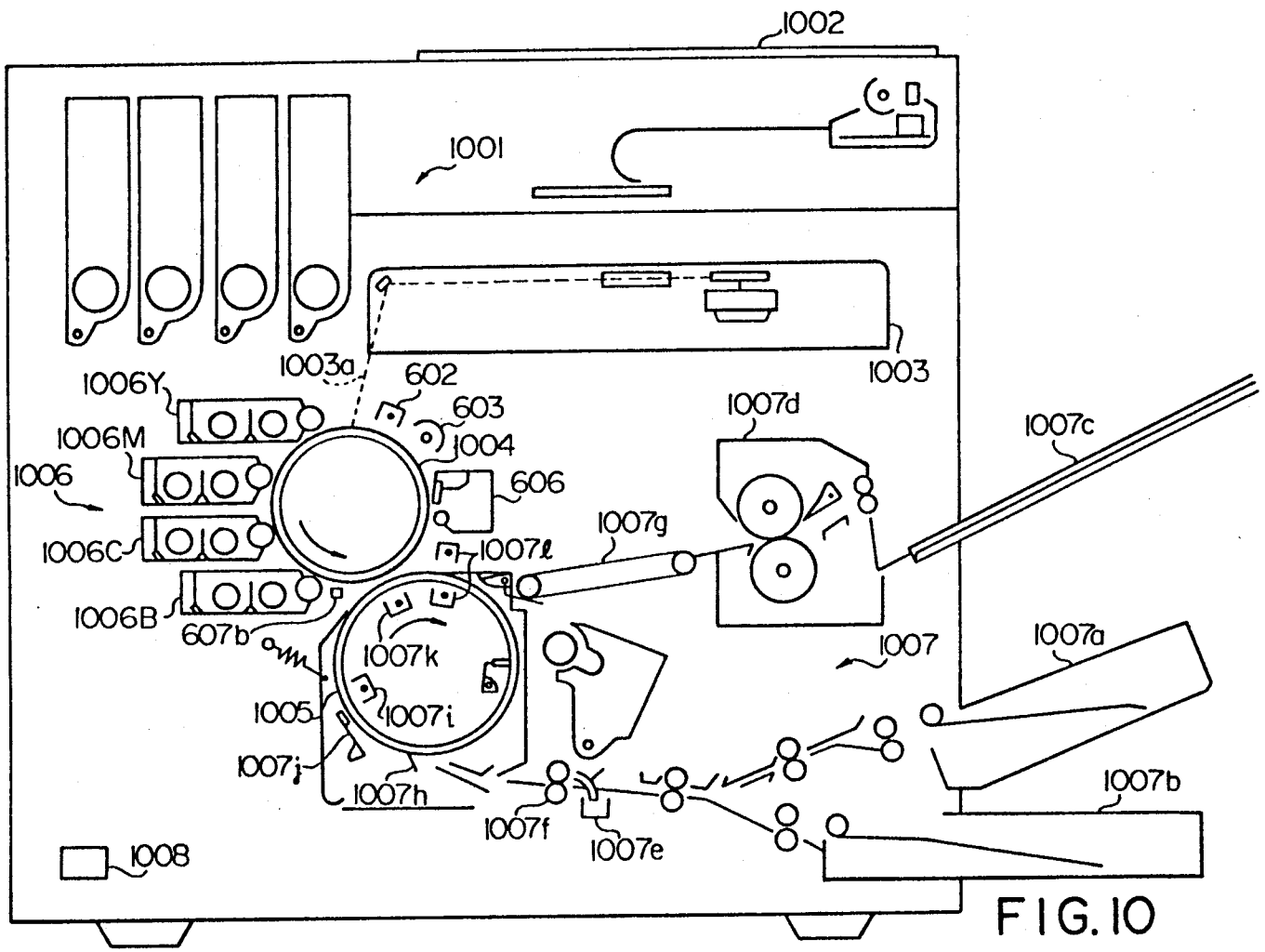
FIG. 10 is a view showing the arrangement of a digital color image duplicating apparatus according to the present invention.

Turning to FIG. 10 of the drawings, an image forming apparatus of a digital color duplicator according to the present invention is illustrated and comprises a document table 1002 and a scanning mechanism 1001 for a document placed on a document table 1002. The scanning mechanism 1001 irradiates the document with light and converts reflection carrying image information into a series of electronic signals and the electronic signals are sequentially supplied to a laser beam controlling unit 1003 for producing electrostatic latent images on a photo-sensitive drum 1004. The electrostatic latent images thus produced with laser beam 1003a are developed into images by using a toner-contained developer and the developed images on the photo-sensitive drum 1004 are transferred to a paper wound on a transfer drum 1005 by an image transfer unit 1006. A paper controlling unit 1007 assists the transfer drum 1005 in the operation by feeding a paper, winding the paper and fixing the transferred toner images.

The scanning mechanism 1001 and the laser beam controlling unit 1003 are similar in structure to those incorporated in a prior art digital color duplicator and, for this reason, no detailed description is incorporated therein.

The paper controlling unit 1007 behaves as follows. A paper is drawn from a paper supply cassette 1007a or 1007b and is allowed to be wound on the transfer drum 1005. The developed toner images are grouped by colors, i.e, four colors in this instance, and are sequentially transferred on the paper wound on the transfer drum 1005. The paper carrying the developed toner images is separated from the transfer drum 1005 and discharged onto a tray 1007c through an image fixing unit 1007d. Reference numeral 1007e designates a paper sensor for detecting a paper passing therethrough and a pair of timing rollers 1007*f* is provided in front of the transfer drum 1005. For transferring a paper from the transfer drum 1005 to the image fixing unit 1007*d*, a conveyer unit 1007*g* is provided therebetween. A scraper 1007*h* is provided on the transfer drum 1005 for catching the leading edge of the paper and a take-up charger 1007*i* is provided inside the transfer drum 1005 for electrostatically fixing the paper on the transfer drum 1005. An opposed electrode 1007*j* is provided in opposing relationship to the take-up charger 1007*i*. Inside the transfer drum 1005 are further provided a transfer charger 1007*k* which causes the developed toner images reproduced on the photo-sensitive drum 1004 to move onto the paper on the drum 1005 by the agency of electrostatic force. A discharging unit 1007*l* is activated after transferring the four-color developed images onto the paper and the transfer drum 1005 is discharged for separation of the paper therefrom.

A humidity sensor 1008 is provided in a certain area which is free from any contamination due to, for example, the toner-contained developer and from any affection of heat generated by an exposure lamp incorporated in the scanning unit 1001 by way of example.

The image transfer unit 1006 is similar in arrangement to that shown in FIG. 6 and, for this reason, the corresponding components are designated by the same reference numerals without any detailed description. Since the image forming apparatus shown in FIG. 10 is of the digital color duplicator type, four developing units 1006Y, 1006M, 1006C and 1006B are provided in association with the four kinds of toner-contained developer. Namely, the developing unit 1006Y is assigned yellow and other developing units 1006M, 1006C and 1006B are respectively used for the images developed in magenta, cyan and black.

Figure 11A:
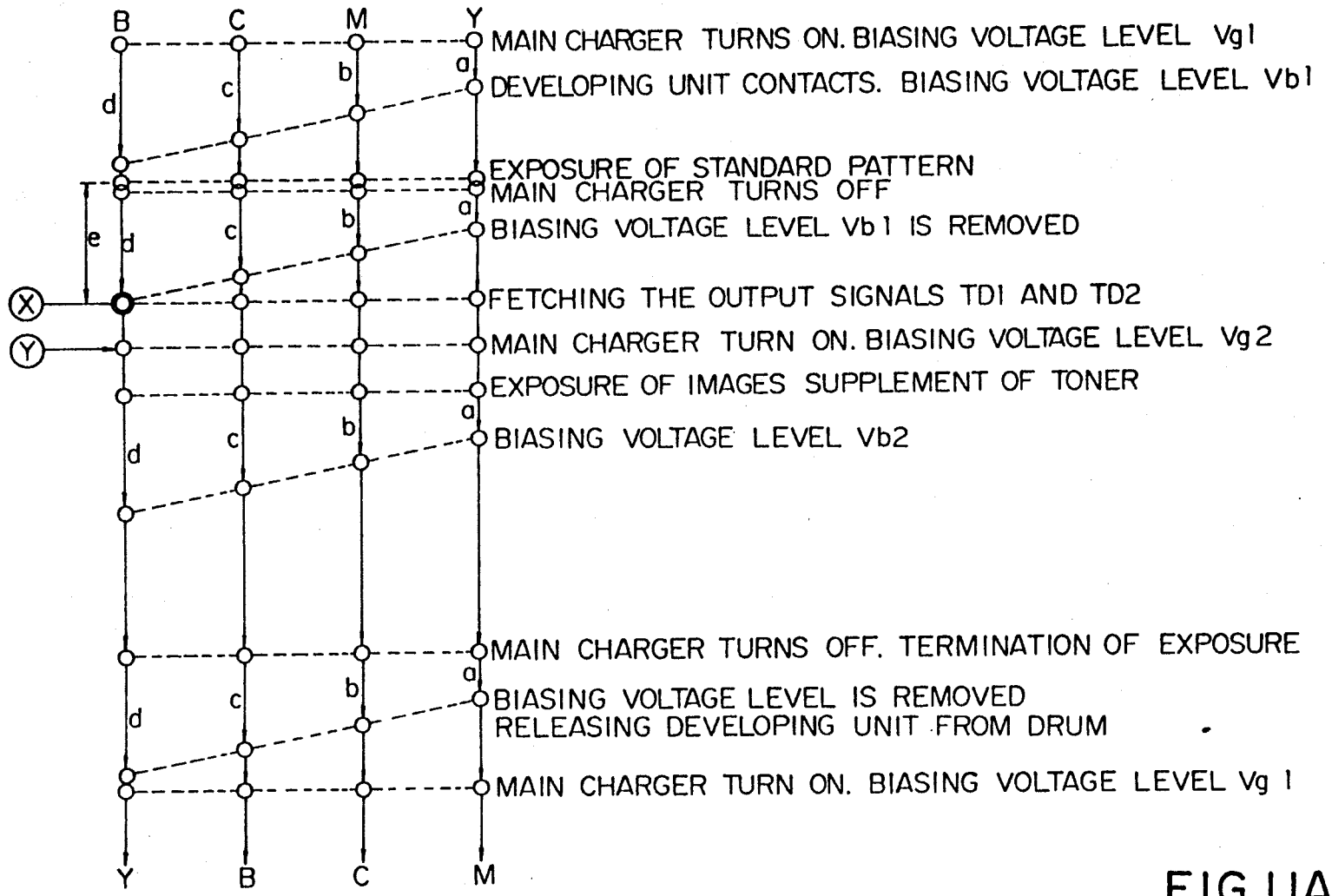
FIGS. 11A and 11B are views showing a sequence of a multiple-color image forming operation executed by the digital color image duplicating apparatus shown in FIG. 10.
Figure 11B:
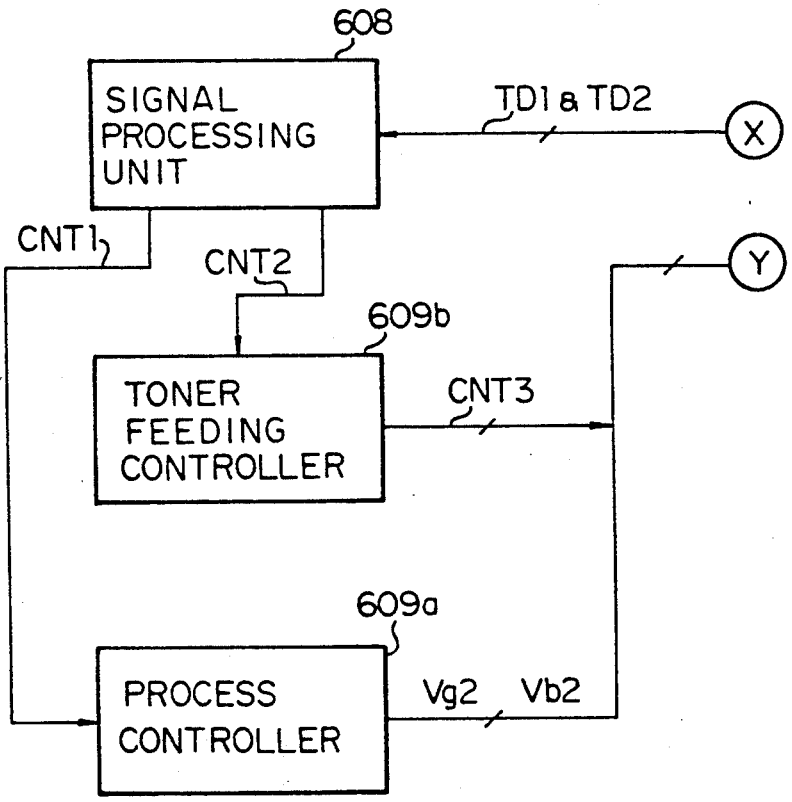
Figure 12:
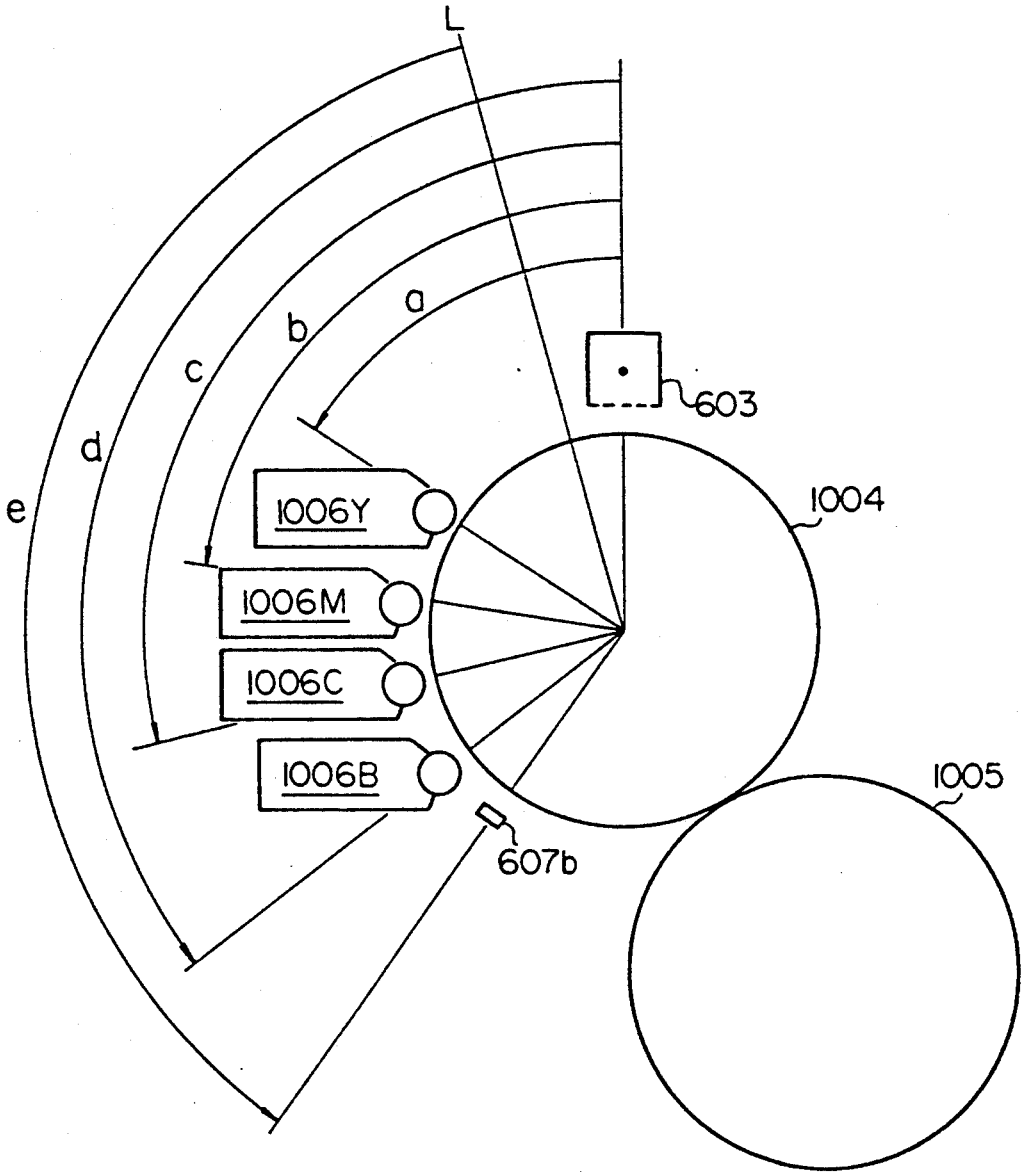
FIG. 12 is a view showing angular positions of the photo-sensitive drum 1004 incorporated in the digital color image duplicating apparatus.

Turning to FIGS. 11A and 11B, a sequence of a multiple-color image forming process is illustrated and each of the small letters (a) to (d) represents a lapse of time between two angular positions of the photo-sensitive drum 1004 as shown in FIG. 12. Capital letters (Y), (M), (C) and (B) stand for images developed in yellow, magenta, cyan and black, respectively. The sequence circulates in a loop consisting of steps for yellow, magenta, cyan and black as indicated in FIG. 11A.

Description is made on formation of images in yellow. First, the mesh-grid 602*a* is adjusted to a predetermined biasing voltage level of Vg1 and the main charger 602 is allowed to turn on. Then, the photo-sensitive drum 1004 is charged up to and the surface voltage level Vo1 thereof is approximately equal to the predetermined value Vg1. After the lapse of time (a) from the main charger being turned on, the leading edge of the charged area on the photo-sensitive drum 1004 arrives at that area beneath the developing unit 1006Y and the developing unit 1006Y is allowed to be brought into contact with the photo-sensitive drum 1004. The developing sleeve incorporated in the developing unit 1006Y is adjusted to a predetermined biasing voltage level Vb1 and a difference in voltage level between Vo1 and Vb1 is about 200 volts in this instance.

After a lapse of time (d) from the main charger turning on, an exposure starts with a standard pattern (which may be a rectangular black pattern of 10 square millimeter). Since the leading edge of the charged area arrives at a position beneath the developing unit 1006B after the lapse of time (d), the developing unit 1006B is brought into contact with the photo-sensitive drum 1004 and the exposure of the standard pattern is carried out for any of the developing units after the contact therewith. For the physical contact between the developing unit and the photo-sensitive drum 1004, the photo-sensitive drum 1004 is vibrated in this instance. An electrostatic latent image of the standard pattern is developed if the electrostatic latent image reaches a developing position after the lapse of time (a) for the developing unit 1006Y.

When the exposure of the standard pattern is completed, the main charger 602 turns off.

After another lapse of time (a) from the main charger turning off, the leading edge of non-charged area arrives at that area beneath the developing unit 1006Y and the biasing voltage level Vb1 is removed from the developing sleeve.

After a lapse of time (e) from the exposure of the standard pattern, the developed toner image of the standard pattern reaches that area beneath the second toner density sensor 607*b* or the optical sensor and the signal processing unit 608 fetches the output signals TD1 and TD2 produced by the first and second toner density sensors 607*a* and 607*b*. The output signals TD1 and TD2 thus fetched are processed as described hereinbefore.

When the signal processing is completed, controlling data such as the grid biasing voltage level Vg2 and the sleeve biasing voltage level Vb2 are determined and the time interval for the toner feeder 604*c* is also calculated for regulating the actual toner density to a target value. The main charger 602 turns on again and is adjusted to the grid biasing voltage level Vg2. The toner feeder 604*c* is responsive to the third control signal CNT3 and starts the feeding operation of toner so as to regulate the toner density. The grid biasing voltage level Vg2 is larger than the biasing voltage level Vg1 and the sleeve biasing voltage level Vb2 is also larger than the biasing voltage level Vb1. When the mesh-grid 602*a* is biased to the voltage level Vg2, the surface of the photo-sensitive drum 1004 goes up to a surface voltage level Vo2 approximately equal to the voltage level Vg2 and a difference in voltage level between the surface of the photo-sensitive drum 1004 and the sleeve is about 200 volts in this instance. After the main charger is turned on, a stable charged area on the photo-sensitive drum 1004 reaches the exposure position L and an exposure of images on a document starts.

After a lapse of time (a) from the time the main charger is turned on, the leading edge of the charged area reaches that area beneath the developing unit 1006Y and the developing sleeve is biased to the voltage level Vb2.

When the exposure of the images is completed, the main charger turns off.

After a lapse of time (a) from the main charger turning off, the leading edge of the non-charged area reaches that area beneath the developing unit 1006Y and the biasing voltage level Vb2 is removed from the developing sleeve. The developing unit 1006Y is released from the photo-sensitive drum 1004.

Thus, the image forming process is completed for the developing unit 1006Y assigned the images developed in yellow and the image forming process are sequentially repeated for the images developed in magenta, cyan and black. A difference between the processes for yellow and any of magenta, cyan and black is a lapse of time. The lapse of time (a) is established for the images developed in yellow, however, the image forming processes for magenta, cyan and black are associated with the lapses of time (b), (c) and (d), respectively. In other words, the contact between the associated developing unit 1006M, 1006C or 1006B and the photosensitive drum 1004, the releasement thereof and the developing sleeve shifted between the on-state and the off-state start at respective timings when the leading edges of the charged area or non-charged area reaches that position beneath the associated developing unit.

Figure 1:
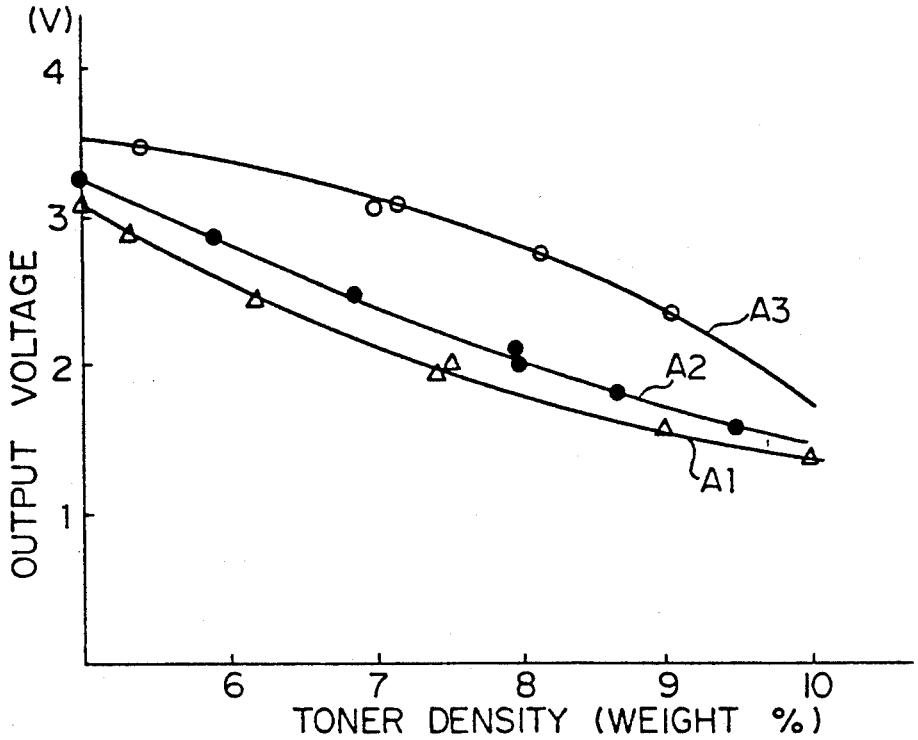
FIG. 1 PRIOR ART
FIG. 1 is a prior art graph showing the output voltage of a magnetic sensor in terms of a toner density.

As described with reference to FIGS. 1 and 3, even if a toner density is constant, the output voltage level of a magnetic sensor is higher than a certain level indicative of the actual toner density at a relatively high humidity but is lower at a relatively low humidity. However, an optical sensor shows a different humidity dependency inversely varied. Namely, an output voltage level of the optical sensor is higher than a standard value at a relatively low humidity but is lower at a relatively high humidity.

Figure 13:
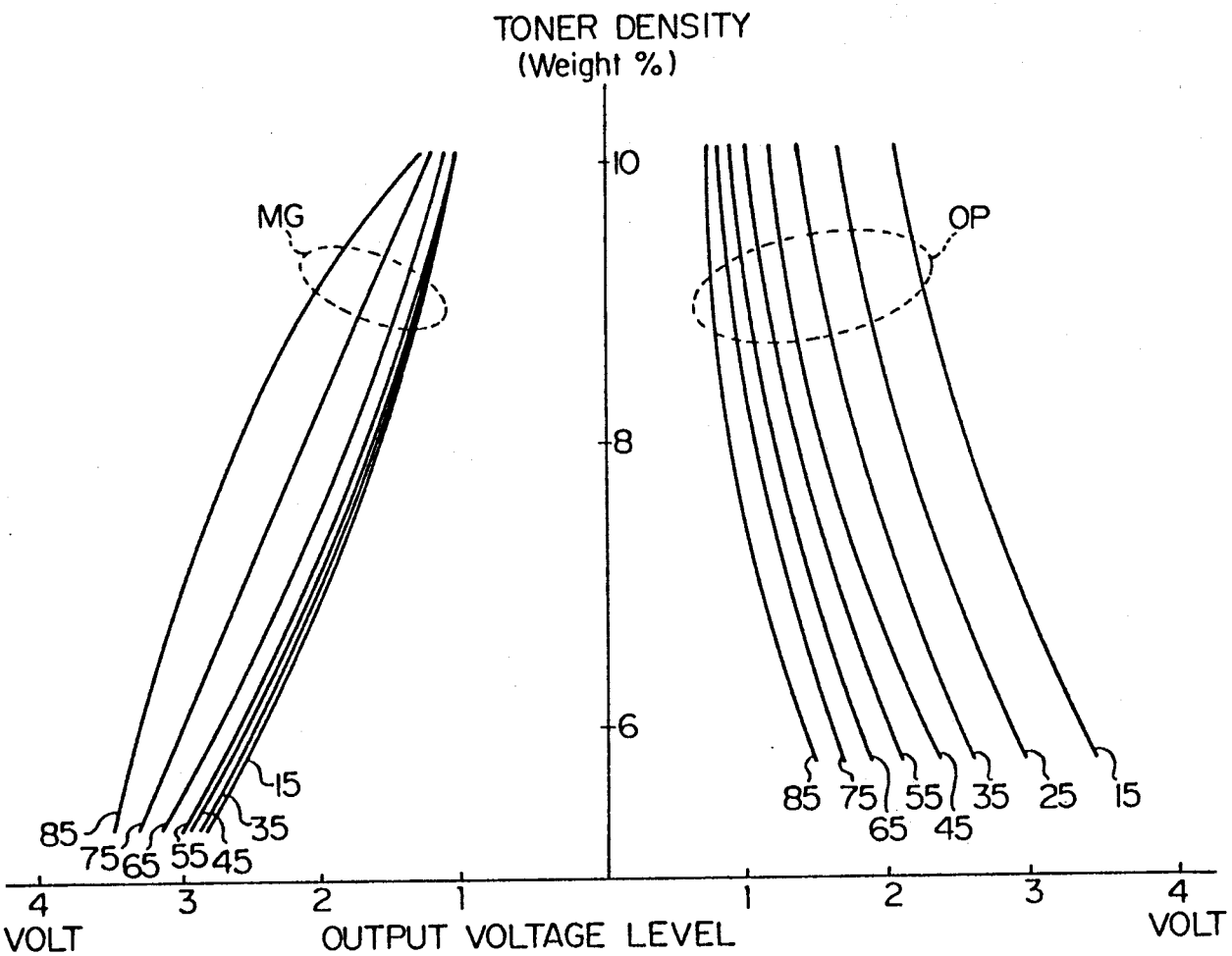
FIG. 13 is a graph showing the output voltage levels of the magnetic an optical sensors in terms of toner density.
Figure 14:
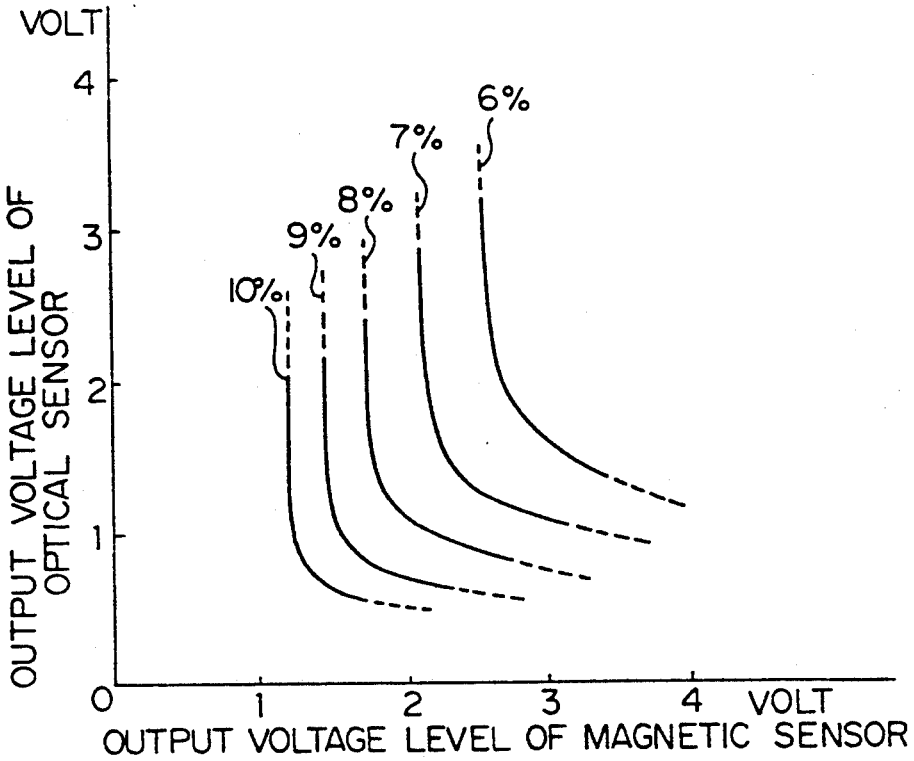
FIG. 14 is a graph showing a relationship between the output voltage levels of the magnetic and optical sensors.

As described hereinbefore, the interrelation between the toner density, the output signals TD1 and TD2 and the humidity is shown in a table for calibration of the magnetic and optical sensors. The table is prepared as follows. First, the output voltage levels of the magnetic and optical sensors are plotted in terms of toner density and humidity is used as a parameter as shown in FIG. 13. the plots bundled and labeled with "MG" stands for the magnetic sensor and the humidity dependency of the optical sensor is represented by the plots labeled with "OP". The parameter ranges from 15% RH to 85% RH. If the output levels of the magnetic and optical sensors at individual humidities are written into a table on the basis of standard actual toner densities, the table shows the interrelation between the humidity, the toner density and the output voltage levels of the magnetic and optical sensors. The toner density range is split into a plurality of standard toner densities as much as variation of the toner density indicated by the output signals TD1 and TD2. FIG. 14 shows a relationship between the output voltage levels of the magnetic and optical sensors and the toner density is used as a parameter. The parameter ranges from 6% by weight to 10% by weight. Preparation of FIG. 14 is easier than that of the table described hereinbefore.

Figure 15:
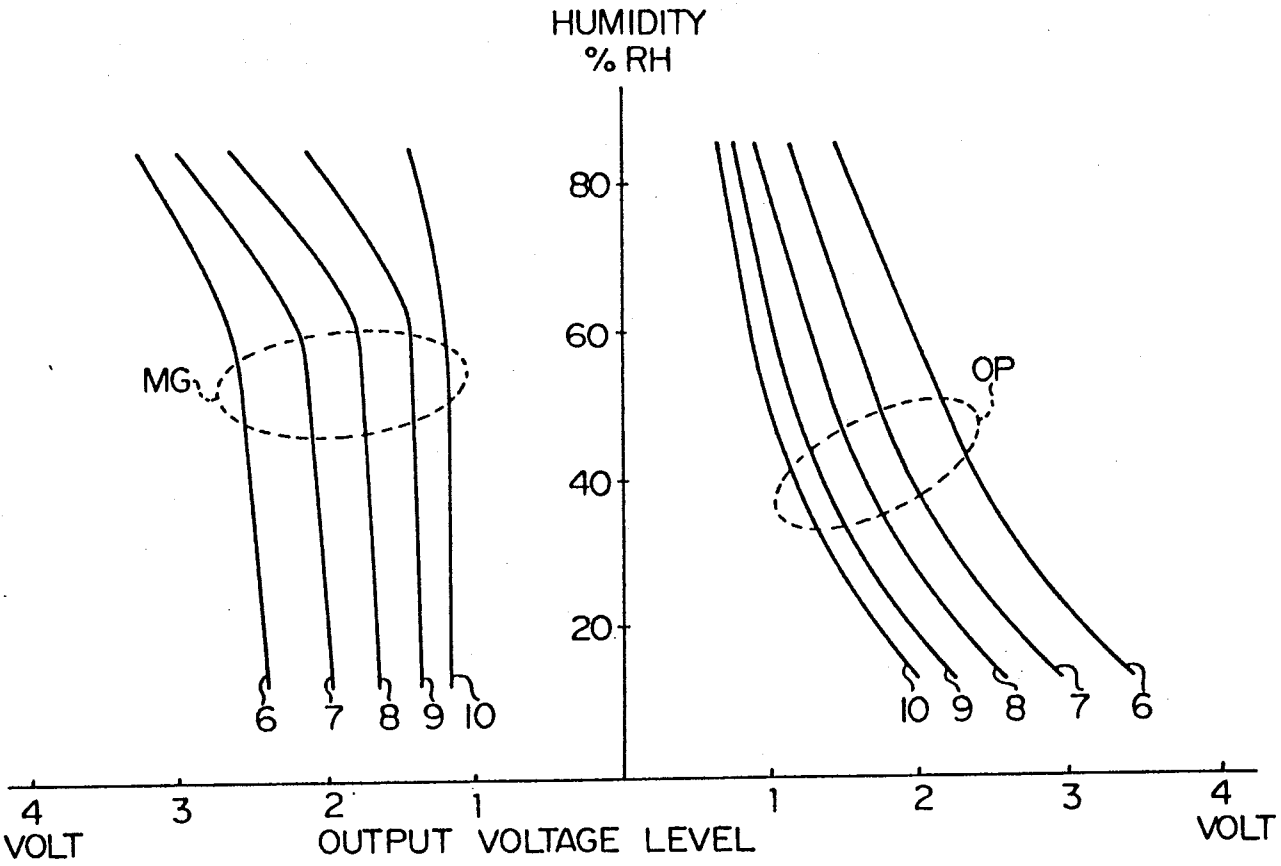
FIG. 15 is a graph showing the output voltage levels of the magnetic and optical sensors in terms of humidity.

FIG. 15 shows the output voltage levels of the magnetic and optical sensors in terms of humidity and the toner density is used as a parameter. The parameter ranges from 6% by weight to 10% by weight and plots separately labeled with "MG" and "OP" stand for the magnetic sensor and the optical sensor, respectively. Using the plots in FIG. 15, the output voltage levels of the magnetic and optical sensors at individual toner densities are written into a table on the basis of standard humidities, then a humidity converting table is prepared. The humidity range is split into a plurality of standard humidities as much as variation of the humidity indicated by the output signal HM.

Figure 16:
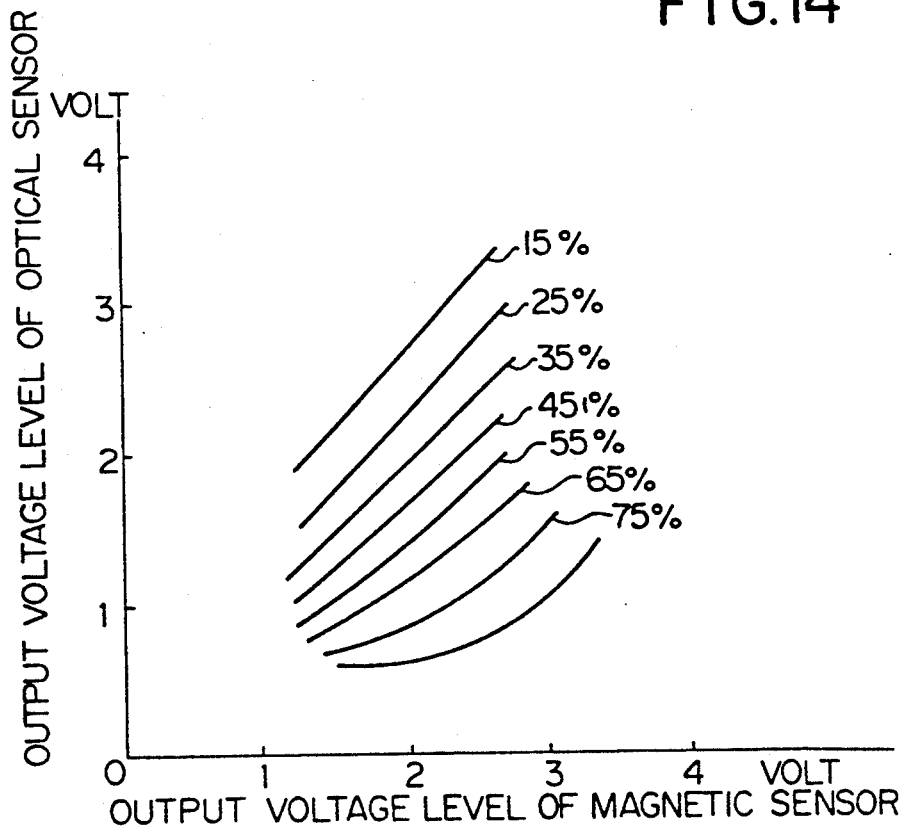
FIG. 16 is a graph showing a relationship between the output voltage levels of the magnetic and optical sensors.

FIG. 16 is a graph showing a relationship between the output voltage levels of the magnetic and optical sensors and the humidity is selected as a parameter. The parameter ranges from 15% RH to 75% RH and preparation of FIG. 16 is easier than that of the table constructed from FIG. 15.

As will be understood from the foregoing description, the controlling unit according to the present invention incorporates the table indicative of the interrelation between the output voltage levels of the sensors 607*a* and 607*b*, the humidity and the toner density and accesses the table for controlling the grid biasing voltage level Vg2 and the sleeve biasing voltage level Vb2 as well as the supplement of toner particles on the basis of the modified data. By virtue of the modification of the data with reference to the table, the supplement of toner particles is optimized regardless of any variation in humidity and images are reproduced by using the optimum toner-contained developer.

Even if an optimum toner density and a precise process control are strictly requested as in case of a digital color duplicator, the controlling unit according to the present invention is responsible and allows the duplicator to reproduce images advantageous in quality, response to a half-tone, brightness of colors and stability.

The magnetic and optical sensors 607*a* and 607*b* incorporated in the controlling unit according to the present invention are calibrated with humidity measured by the humidity sensor 607*c* and, for this reason, any fluctuation due to the variation in humidity is canceled from each of the output signal TD1 or TD2. This results in an accurate toner density control which improves images to be reproduced.

Moreover, the grid and sleeve biasing voltage levels are precisely controlled with reference to an actual humidity and, for this reason, the parameters in an image forming operation are optimized and conducive to qualified images to be reproduced.

Although a particular embodiment of the present invention has been shown and described, it will be obvious to those skilled in the art that various changes and modifications may be made without departing from the spirit and scope of the present invention. For example, the controlling unit described hereinbefore controls the grid and sleeve biasing voltage levels but another implementation may control one of or any combination of other parameters such as, for example, intensity of an exposure light, a rotational speed of the developing sleeve and an output voltage level of the transfer charger. Moreover, humidity is measured in the above mentioned controlling unit, however, another controlling unit may monitor another variation of environment and toner density is measured with different type of sensor from the magnetic and optical sensors.

What is claimed:

1. A photoelectric image forming apparatus for reproducing an image on the basis of an electrostatic latent image produced on a photo-sensitive member by using a developer unit containing a toner and a carrier, comprising:

a) a plurality of toner density measuring means for respectively producing signal outputs, each indicative of a toner density of said developer as affected by humidity conditions;

b) means for calculating humidity in the developer unit on the basis of said output signals from said plurality of toner density measuring means, and c) toner density determining means, responsive to said signal outputs, for determining an actual toner density for said developer unit.

2. The photoelectric image forming apparatus of claim 1, further including means for displaying the calculated humidity in the developer unit.

3. A photoelectric image forming apparatus for reproducing an image on the basis of an electrostatic latent image produced on a photosensitive member by using a developer containing a toner and a carrier, comprising:

a plurality of toner density measuring means for respectively producing outputs, each indicative of a toner density of said developer;

toner density determining means, responsive to said outputs, for determining an actual toner density of said developer, in which said plurality of toner density measuring means have different output characteristics respectively variable with humidity, including means for compensating for the humidity, and estimating means for calculating a humidity in a developing unit accommodating said developer on the basis of said outputs fed from said plurality of toner density measuring means.

4. A photoelectric image forming apparatus for reproducing an image on the basis of an electrostatic latent image produced on a photosensitive member by using a developer containing a toner and a carrier, comprising:

a plurality of toner density measuring means for producing respective outputs, each indicative of a toner density of said developer, said plurality of toner density measuring means having respective output characteristics variable with humidity, and including a first toner density measuring means for measuring the amount of magnetic flux passing through said developer, and a second toner density measuring means for optically measuring a tone of an image produced from a standard document;

estimating means for calculating humidity in a developing unit accommodating said developer on the basis of said outputs fed from said first and second toner density measuring means;

parameter determining means for modifying parameters of an image reproducing operation depending upon said humidity to be measured;

toner density determining means, responsive to said outputs modified by said modifying means, for determining an actual toner density of said developer, and toner density controlling means for supplying said toner to said developer depending upon said actual toner density of said developer.

* * * * *